US008157411B2

(12) United States Patent
Tabuchi et al.

(10) Patent No.: US 8,157,411 B2
(45) Date of Patent: Apr. 17, 2012

(54) ILLUMINATING DEVICE

(75) Inventors: Tomoya Tabuchi, Higashiomi (JP); Hidetaka Katou, Higashiomi (JP)

(73) Assignee: KYOCERA Corporation, Kyoto (JP)

( * ) Notice: Subject to any disclaimer, the term of this patent is extended or adjusted under 35 U.S.C. 154(b) by 550 days.

(21) Appl. No.: 11/959,130

(22) Filed: Dec. 18, 2007

(65) Prior Publication Data

US 2008/0151544 A1 Jun. 26, 2008

(30) Foreign Application Priority Data

Dec. 20, 2006 (JP) ..... 2006-342602

(51) Int. Cl.
*F21V 1/00* (2006.01)

(52) U.S. Cl. ..... 362/241; 362/97.3; 362/245; 362/247; 362/249.02

(58) Field of Classification Search ..... 362/97.1–97.3, 362/241, 245, 247, 249.02, 249.06
See application file for complete search history.

(56) References Cited

U.S. PATENT DOCUMENTS 5,580,156 A 12/1996 Suzuki et al.
7,035,015 B2 * 4/2006 Teijido ..... 362/19
2004/0085779 A1 5/2004 Pond et al.
2004/0120158 A1 6/2004 Tatsukawa et al.
2005/0265035 A1 12/2005 Brass et al.
2007/0047219 A1 * 3/2007 Thompson et al. ..... 362/97
2007/0081351 A1 4/2007 Liu

FOREIGN PATENT DOCUMENTS

JP 2006-049715 2/2006

OTHER PUBLICATIONS

European Search Report dated Mar. 2, 2011 for a counterpart European Application No. EP 07024721.
Communication from European Patent Office dated Mar. 7, 2011 for counterpart European Application No. 07 024 721.8.

* cited by examiner

*Primary Examiner* — Stephen F Husar
(74) *Attorney, Agent, or Firm* — Procopio, Cory, Hargreaves & Savitch LLP

(57) ABSTRACT

An illuminating device includes a plurality of light-emitting diodes, a plurality of first light-reflecting parts, and a plurality of second light-reflecting parts. Each of the plurality of first light-reflecting parts has a first light reflecting surface surrounding one of the light-emitting diodes. Each of the plurality of second light-reflecting parts has a second light reflecting surface surrounding one of the light-emitting diodes. The shape of the first light reflecting surface is different from that of the second light reflecting surface.

11 Claims, 13 Drawing Sheets

ILLUMINATING DEVICE

CROSS-REFERENCE TO RELATED APPLICATION

This application claims priority under 35 U.S.C. §119 to Japanese Application No. 2006-342602, filed Dec. 20, 2006, titled ILLUMINATING DEVICE, which is hereby incorporated by reference.

BACKGROUND

1. Field of the Invention

The present invention relates to illuminating devices including light-emitting diodes.

2. Description of the Related Art

Recently, illuminating devices including light-emitting diodes have been developed. Illuminating devices including light-emitting diodes are small and have long lives, and are therefore expected as future illuminating devices. An illuminating device including a plurality of light-emitting diodes has been developed. Such an illuminating device illuminates an irradiation region with light generated by the plurality of light-emitting diodes.

SUMMARY OF THE INVENTION

According to an aspect of the present invention, an illuminating device includes a plurality of light-emitting diodes, a plurality of first light-reflecting parts, and a plurality of second light-reflecting parts. Each of the plurality of first light-reflecting parts has a first light reflecting surface surrounding one of the light-emitting diodes. Each of the plurality of second light-reflecting parts has a second light reflecting surface surrounding one of the light-emitting diodes. The shape of the first light reflecting surface is different from that of the second light reflecting surface.

According to another aspect of the present invention, an illuminating device includes a plurality of light sources, converting means, and light-flux forming means. The plurality of light sources emit visible light. The converting means converts the visible light from the light sources into substantially parallel light. The light-flux forming means emits the visible light as a non-parallel light flux.

According to another aspect of the present invention, an illuminating device includes a first light-emitting part and a second light-emitting part. The first light-emitting part emits first light. The second light-emitting part emits second light having a dispersibility different from that of the first light.

DESCRIPTION OF THE PREFERRED EMBODIMENTS

Figure 1:
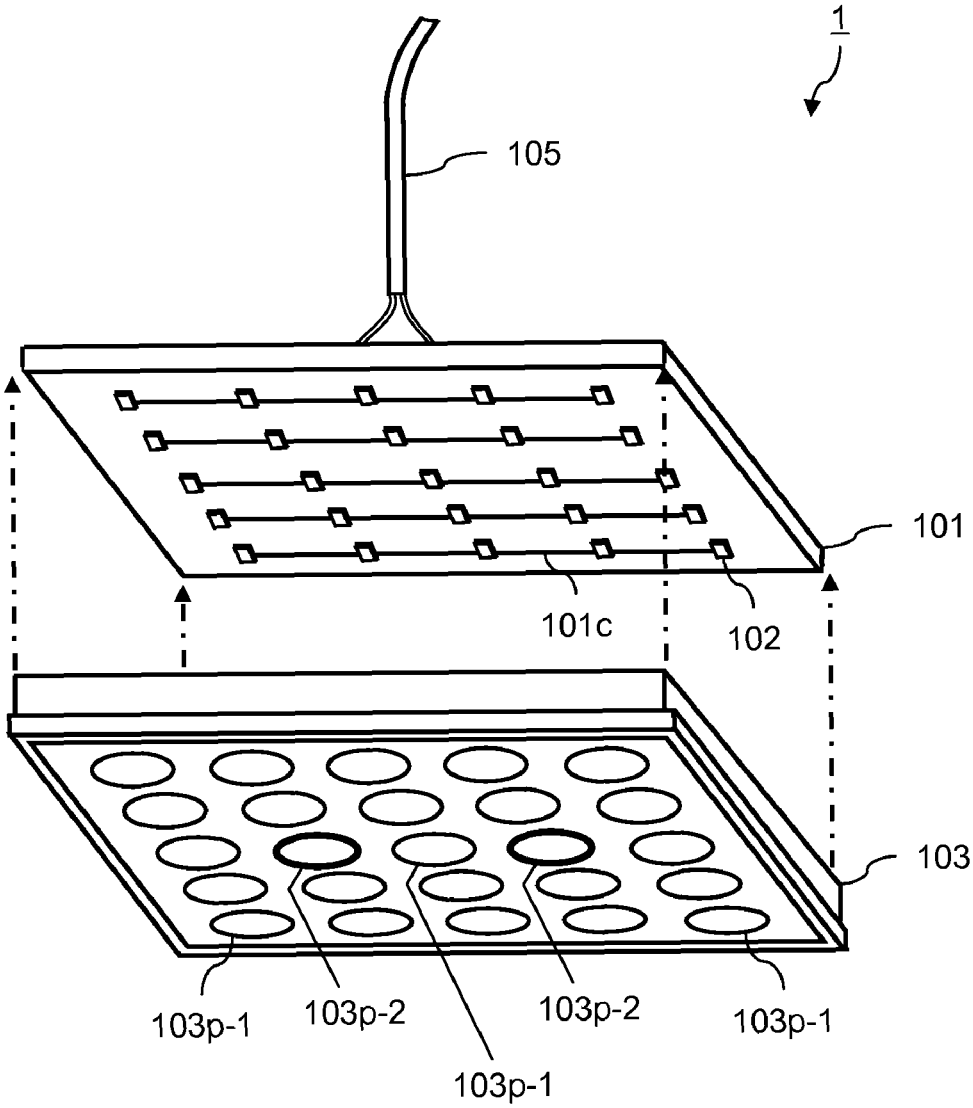
FIG. 1 is an exploded view illustrating an illuminating device according to an embodiment of the present invention.

An illuminating device 1 according to a first embodiment of the present invention will now be described with reference to the accompanying drawings. The illuminating device 1 includes a substrate 101, a plurality of light-emitting diodes 102, and a reflector 103. The substrate 101 has a conductive pattern 101*c* that is electrically connected to the light-emitting diodes 102. The conductive pattern 101*c* is also electrically connected to a power source line 105.

Figure 2:
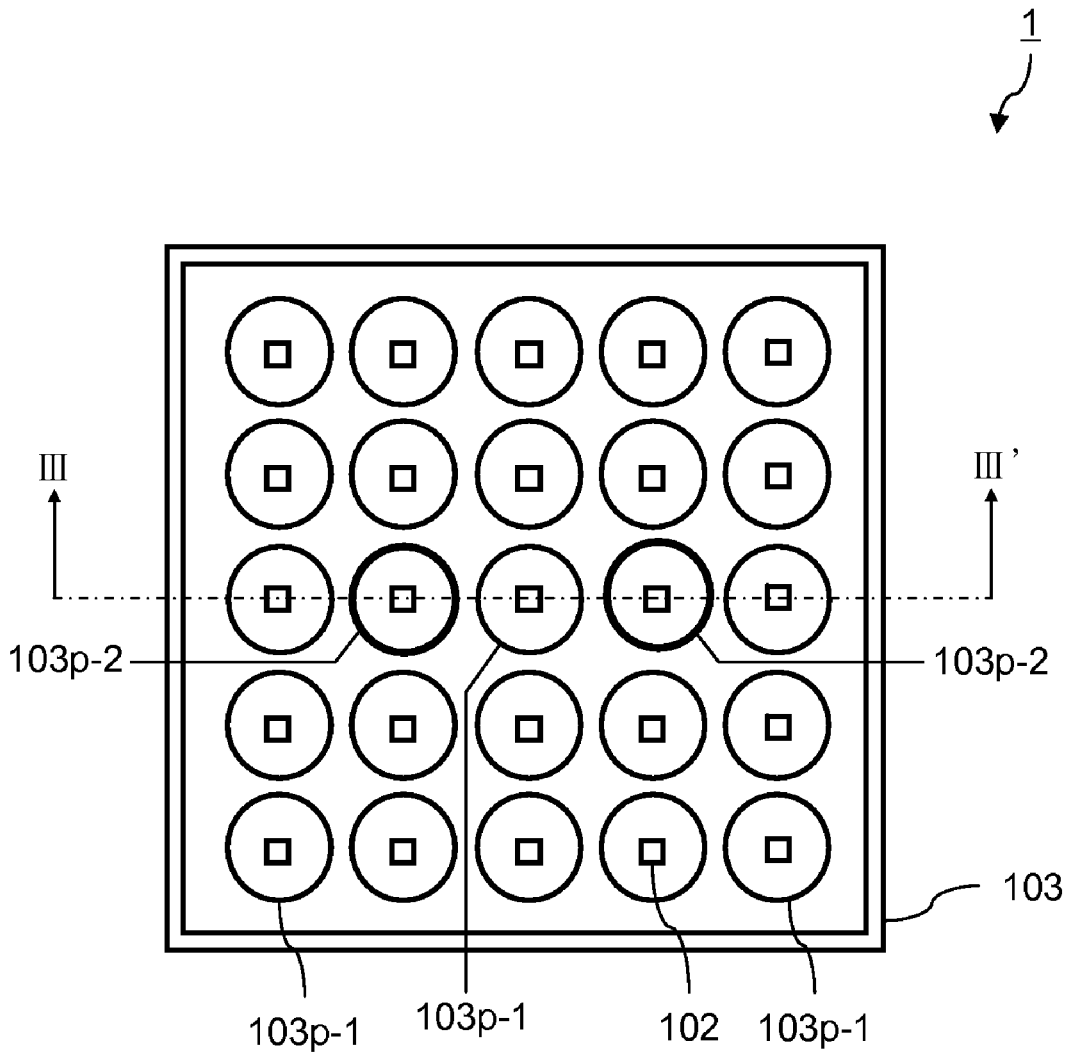
FIG. 2 is a plan view of the illuminating device illustrated in FIG. 1.
Figure 3:
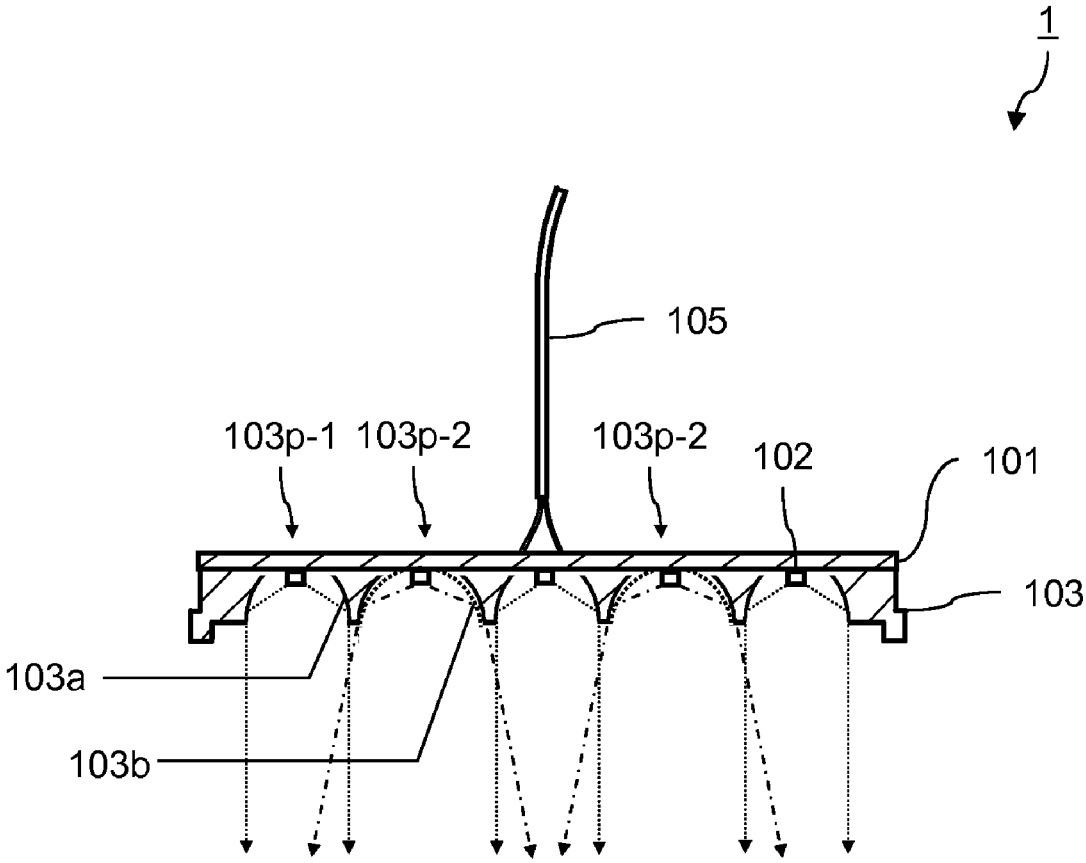
FIG. 3 is a sectional view of the illuminating device illustrated in FIG. 2 taken along line III-III'.
Figure 4:
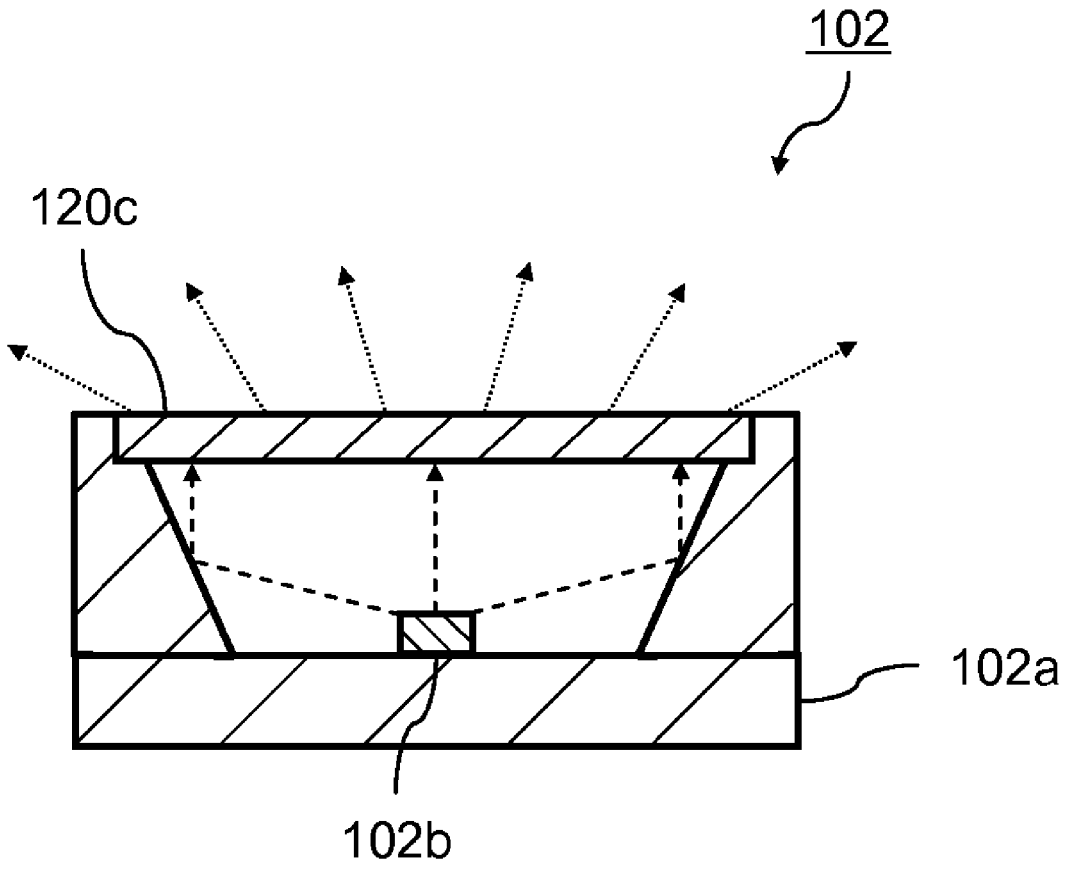
FIG. 4 is a longitudinal sectional view illustrating a light-emitting diode that can be used in the embodiment.

The light-emitting diodes 102 are mounted on the substrate 101, and are electrically connected to the conductive pattern 101*c*. In the present embodiment, "light-emitting diode" means a light-emitting diode lamp or a light-emitting diode chip. The light-emitting diodes 102 shown in FIGS. 1 to 3 are light-emitting diode lamps. Another example of a light-emitting diode is a white-light-emitting diode chip. The light-emitting diodes 102 are light sources that emit visible light. As shown in FIG. 4, each of the light-emitting diodes 102 includes a base 102*a*, a light-emitting diode chip 102*b*, and a light emitter 102*c*. The base 102*a* is a package. Another example of the base 102*a* is a flat plate. The light-emitting diode chip 102*b* is made of a semiconductor material, and emits blue light or ultraviolet light. The light emitter 102*c* converts the wavelength of light emitted from the light-emitting diode chip 102*b*. The light emitter 102*c* may generate red light, green light, and blue light. The light emitter 102*c* has a transparent base material and a fluorescent material contained in the base material. The "transparency" of the base material means that at least a part of light emitted from the light-emitting diode chip 102*b* is allowed to pass therethrough. The fluorescent material is excited by the light emitted from the light-emitting diode chip 102*b*. The light-emitting diode 102 emits mixed light, i.e., white light.

Figure 5:
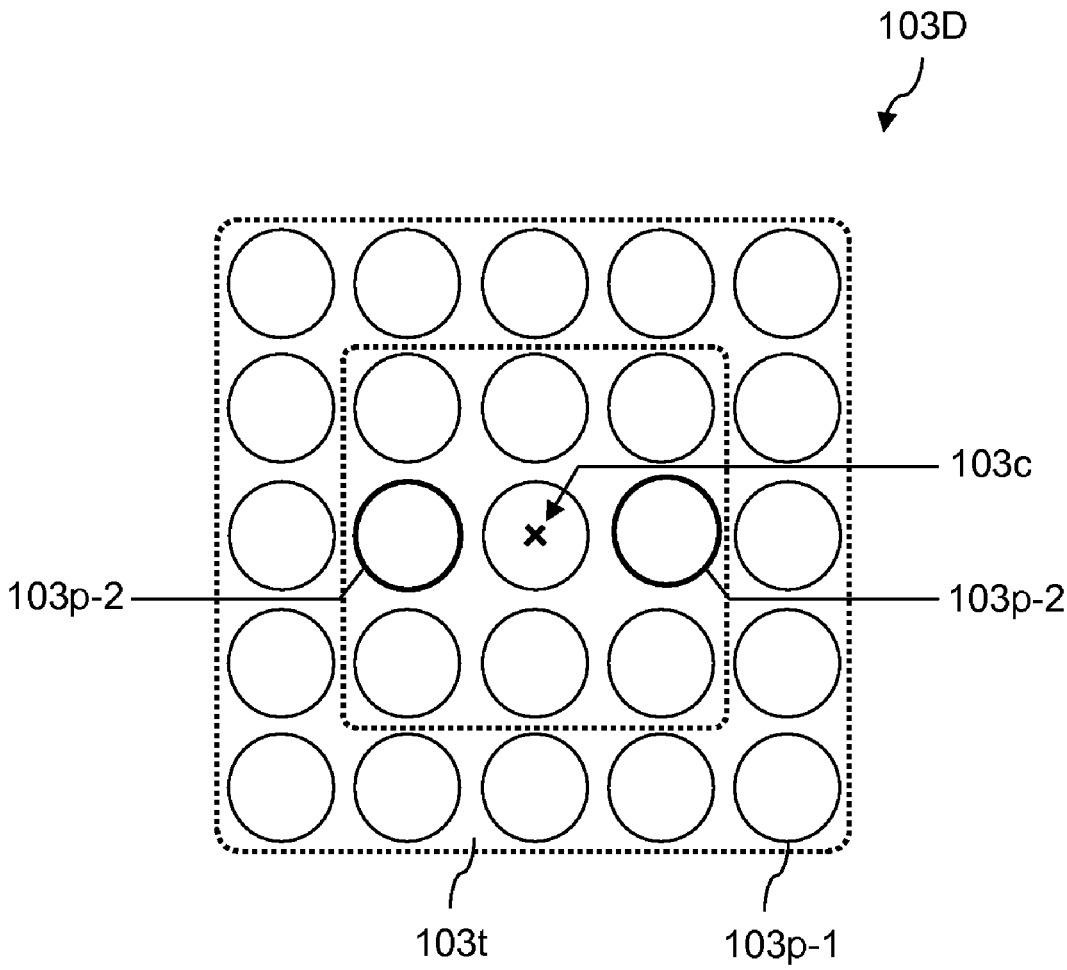
FIG. 5 illustrates an arrangement of light reflecting parts.

The reflector 103 has a plurality of light reflecting parts. The light reflecting parts include a plurality of first light-reflecting parts 103*p*-1 and a plurality of second light-reflecting parts 103*p*-2. The first light-reflecting parts 103*p*-1 emit first light. The second light-reflecting parts 103*p*-2 emit second light having a dispersibility different from that of the first light. The first light-reflecting parts 103*p*-1 are two-dimensionally arranged. As shown in FIG. 3, each of the first light-reflecting parts 103*p*-1 has a first light reflecting surface 103*a* surrounding one of the light-emitting diodes 102. Each of the second light-reflecting parts 103*p*-2 has a second light reflecting surface 103*b* surrounding one of the light-emitting diodes 102. The first light reflecting surfaces 103*a* of the first light-reflecting parts 103*p*-1 and the second light reflecting surfaces 103*b* of the second light-reflecting parts 103*p*-2 are arranged in accordance with the light-emitting diodes 102. As shown in FIG. 5, the second light-reflecting parts 103*p*-2 are arranged symmetrically about an arrangement center 103*c* of the first light-reflecting parts 103*p*-1. The second light-reflecting parts 103*p*-2 are disposed inside an outermost periphery 103*t* of an overall arrangement 103D of the first light-reflecting parts 103-*p*1 and the second light-reflecting parts 103-*p*2. The first light-reflecting parts 103-*p*1 are disposed along the outermost periphery 103*t* of the overall arrangement 103D. In FIG. 5, two second light-reflecting parts 103-*p*2 are surrounded by twenty three first light-reflecting parts 103*p*-1.

Figure 6:
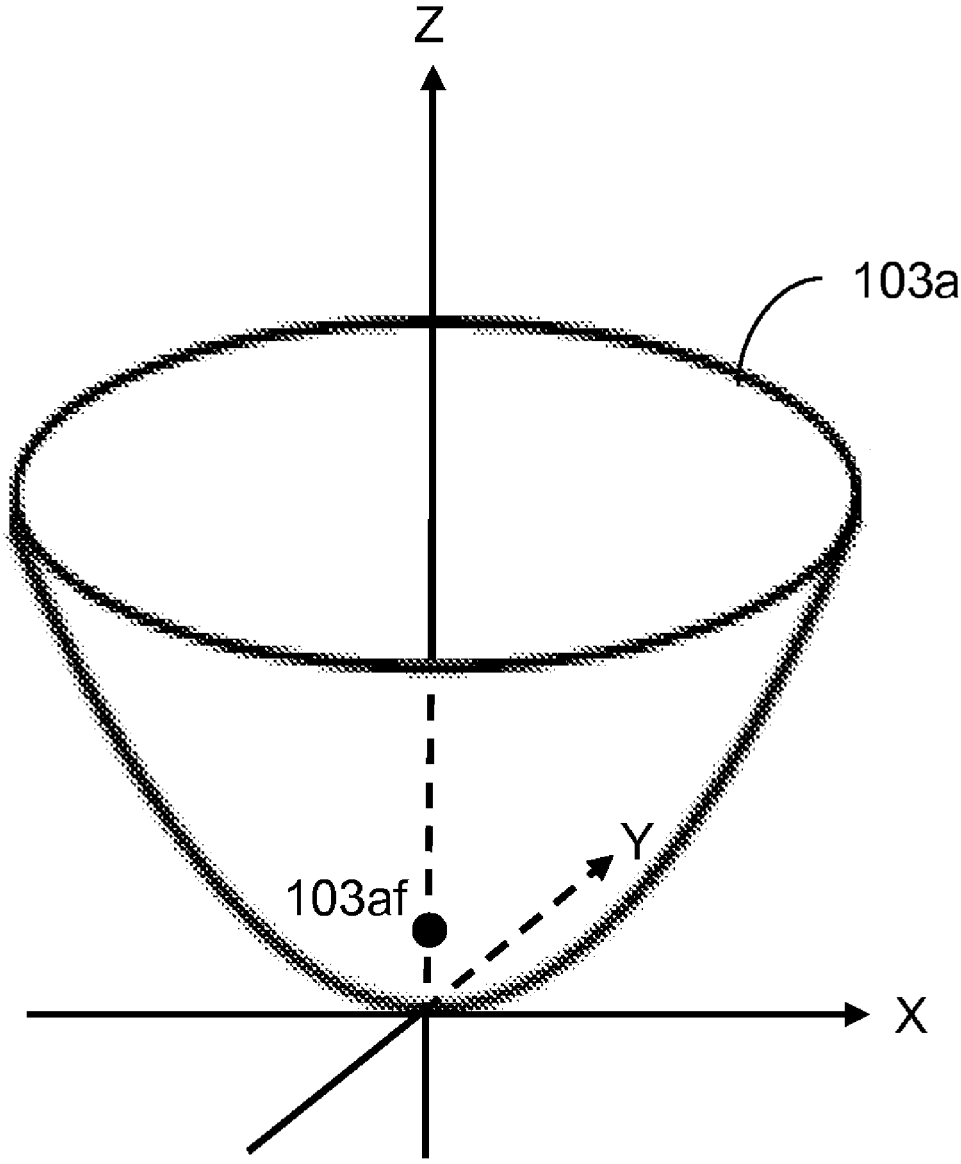
FIG. 6 illustrates the shape of a first light reflecting surface.

The shape of each of the second light reflecting surfaces 103*b* is different from that of each of the first light reflecting surfaces 103*a*. As shown in FIG. 6, each of the first light reflecting surfaces 103*a* is a parabolic surface. The "parabolic surface" is a quadric surface obtained by rotating a parabola around an axis of symmetry Z. In FIG. 6, the XYZ coordinates are orthogonal coordinates. One of the light-emitting diodes 102 (not shown) is disposed at a focus 103*af* of the parabolic surface. The first light reflecting surfaces 103*a* collimate and reflect light emitted from the light-emitting diodes 102. The first light reflecting surfaces 103*a* convert the visible light emitted from the light sources into substantially parallel light. In other words, the first light-reflecting parts 103*p*-1 serve as converting means that converts the visible light from the light sources into substantially parallel light.

Figure 7:
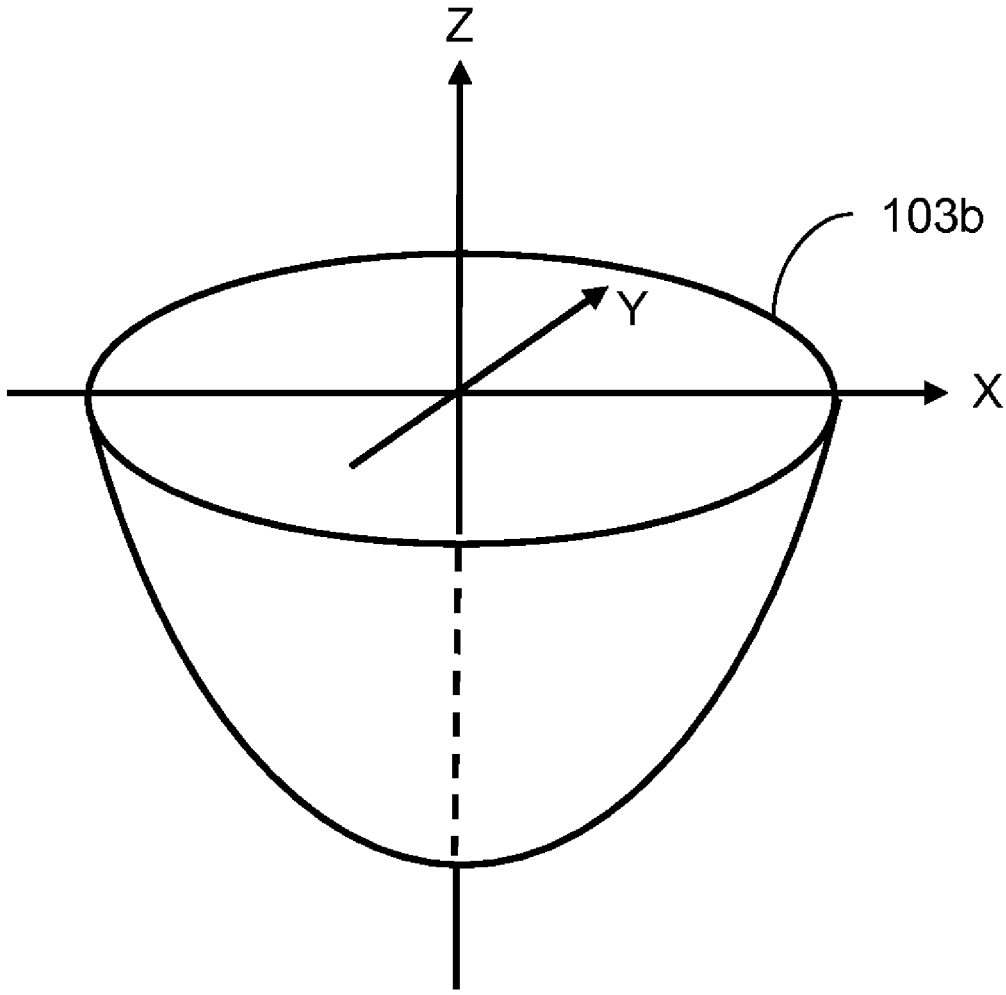
FIG. 7 illustrates the shape of a second light reflecting surface.

As shown in FIG. 7, each of the second light reflecting surfaces 103*b* is an ellipsoidal surface. The "ellipsoidal surface" is a quadric surface expressed as follows:

$$(x^2/a^2)+(y^2/b^2)+(z^2/c^2)=1$$

Each of the second light reflecting surfaces 103*b* is a spheroid surface with respect to the Z axis. In FIG. 7, the XYZ coordinates are orthogonal coordinates. Each of the second light-reflecting parts 103*p*-2 emits annular light.

Figure 8:
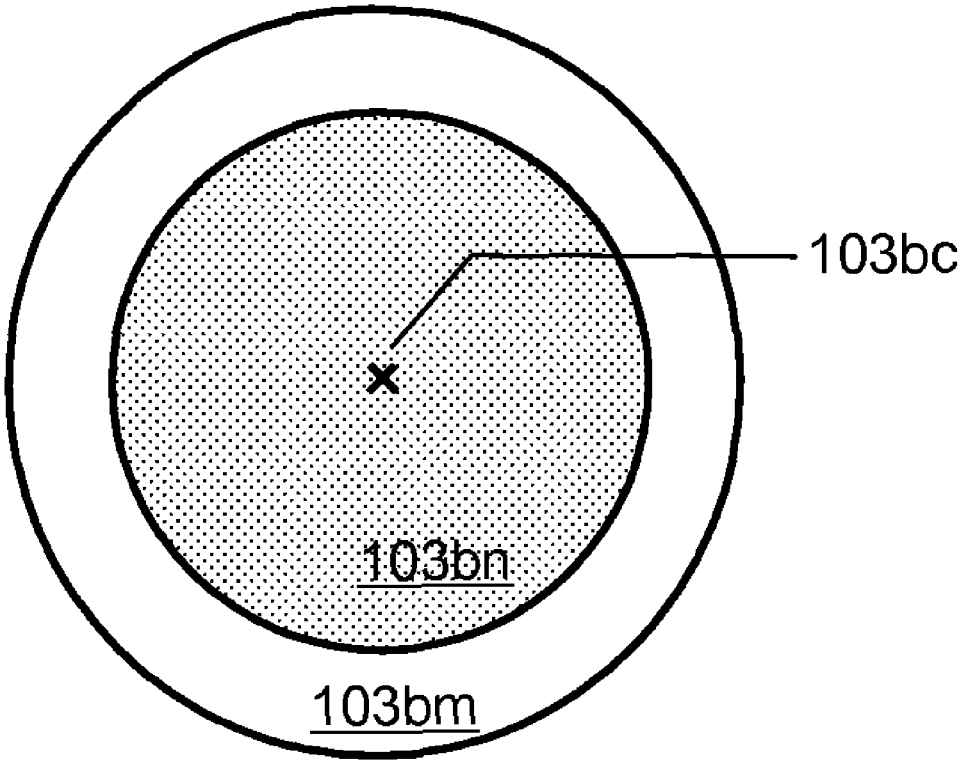
FIG. 8 illustrates the shape of light emitted from a second light-reflecting part on a virtual plane.

Referring to FIG. 8, the "annular light" means light having an annular high-illuminance region 103*bm* in the irradiation region. The illuminance in a region 103*bn* including the center 103*bc* of the irradiation region and surrounded by the region 103*bm* is smaller than the illuminance in the region 103*bm*. The irradiation region refers to a region irradiated by light on a virtual plane (for example, a plane 10 cm away from the light-emitting diode 102). The second light reflecting parts 103*p*-2 serve as light-flux forming means that emits the visible light from the light sources as a non-parallel light flux.

Figure 9:
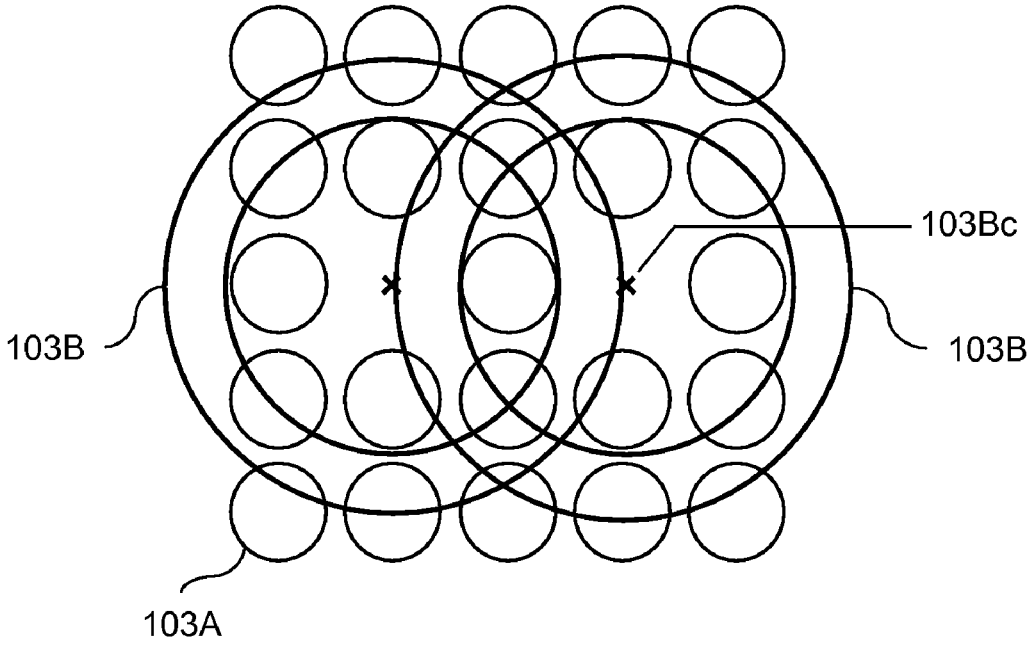
FIG. 9 illustrates an irradiation region of the illuminating device.

As shown in FIG. 9, in the irradiation region, light beams 103B emitted from the second light-reflecting parts 103*p*-2 overlap light beams 103A emitted from the first light-reflecting parts 103*p*-1. Thus, the light beams 103B and the light beams 103A overlap one another. The light beams 103*b* may or may not overlap each other. A center of the light beams 103B is shown by reference numeral 103Bc. The illuminating device 1 emits mixed light of the light beams 103A emitted from the first light-reflecting parts 103*p*-1 and light beams 103B emitted from the second light-reflecting parts 103*p*-2. The illuminating device 1 includes the second light reflecting surfaces 103*b* having a curved shape that is different from the shape of the first light reflecting surfaces 103*a*. Therefore, the illuminance uniformity is improved in the irradiation region. That is, two kinds of lights with different dispersibility make the illuminance more uniform in the irradiation region.

The second light reflecting surfaces 103*b* are preferably rougher than the first light reflecting surfaces 103*a*. The first light reflecting surfaces 103*a* may be mirror surfaces. The second light reflecting surfaces 103*b* are light-scattering surfaces. Light emitted from each of the second light-reflecting parts 103*p*-2 is diffused light. The "diffused light" refers to light having a lower directionality than that of light reflected by each of the first light reflecting surfaces 103*a*. The illuminating device 1 includes the second light reflecting surfaces 103*b* having a surface state different from that of the first light reflecting surfaces 103*a*. Therefore, the illuminance uniformity is improved in the irradiation region.

Figure 10:
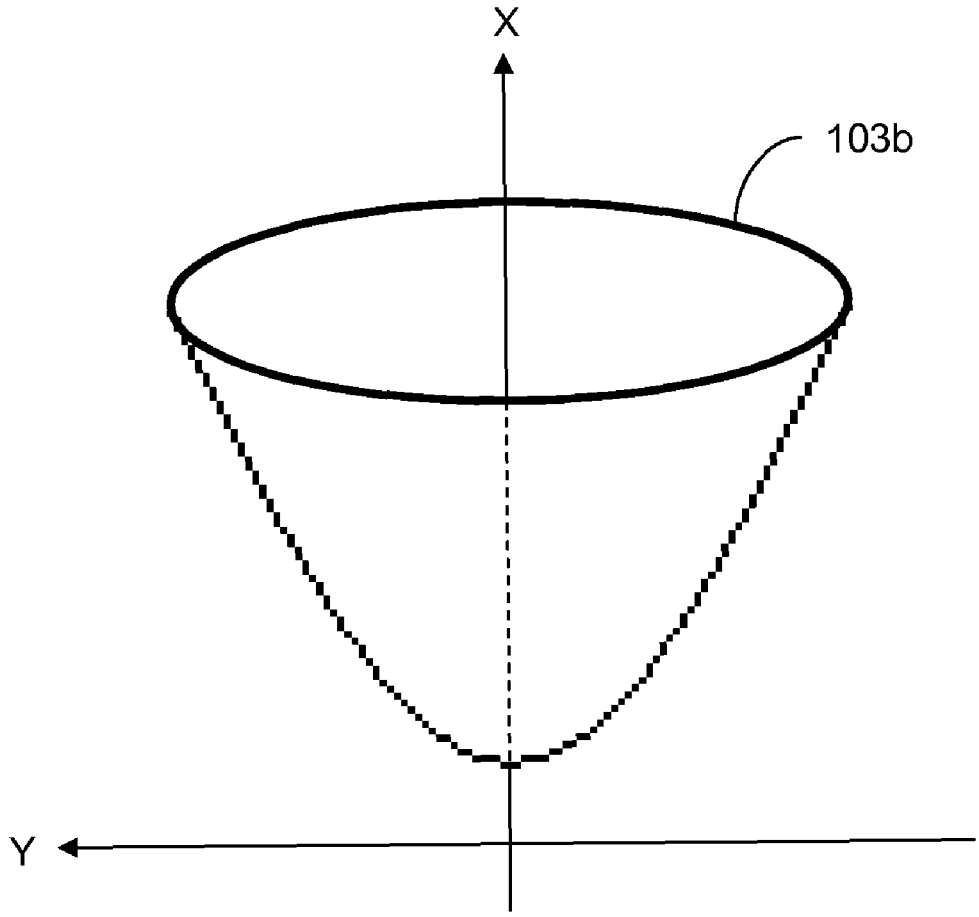
FIG. 10 illustrates the shape of a second light reflecting surface in an illuminating device according to another embodiment of the present invention.

An illuminating device 1 according to second embodiment of the present invention will now be described. The second embodiment differs in the shape of the second light reflecting surfaces 103*b* from the first embodiment. The second light reflecting surface 103*b* is a hyperboloidal surface in the second embodiment. Referring to FIG. 10, the "hyperboloidal surface" is a quadric surface obtained by rotating a hyperbola around an axis of symmetry X. The hyperbola is expressed as follows:

$$x^2/a^2-y^2/b^2=1$$

Each of the second light-reflecting parts 103*p*-2 having the second light reflecting surfaces 103*b* emits annular light. Light beams emitted from the second light-reflecting parts 103*p*-2 overlap light beams emitted from the first light-reflecting parts 103*p*-1. The illuminating device 1 includes the second light reflecting surfaces 103*b* having a curved shape that is different from the shape of the first light reflecting surfaces 103*a*. Therefore, the illuminance uniformity is improved in the irradiation region. The second light reflecting surfaces 103*b* are light-scattering surfaces. Light emitted from each of the second light-reflecting parts 103*p*-2 is diffused light.

Figure 11:
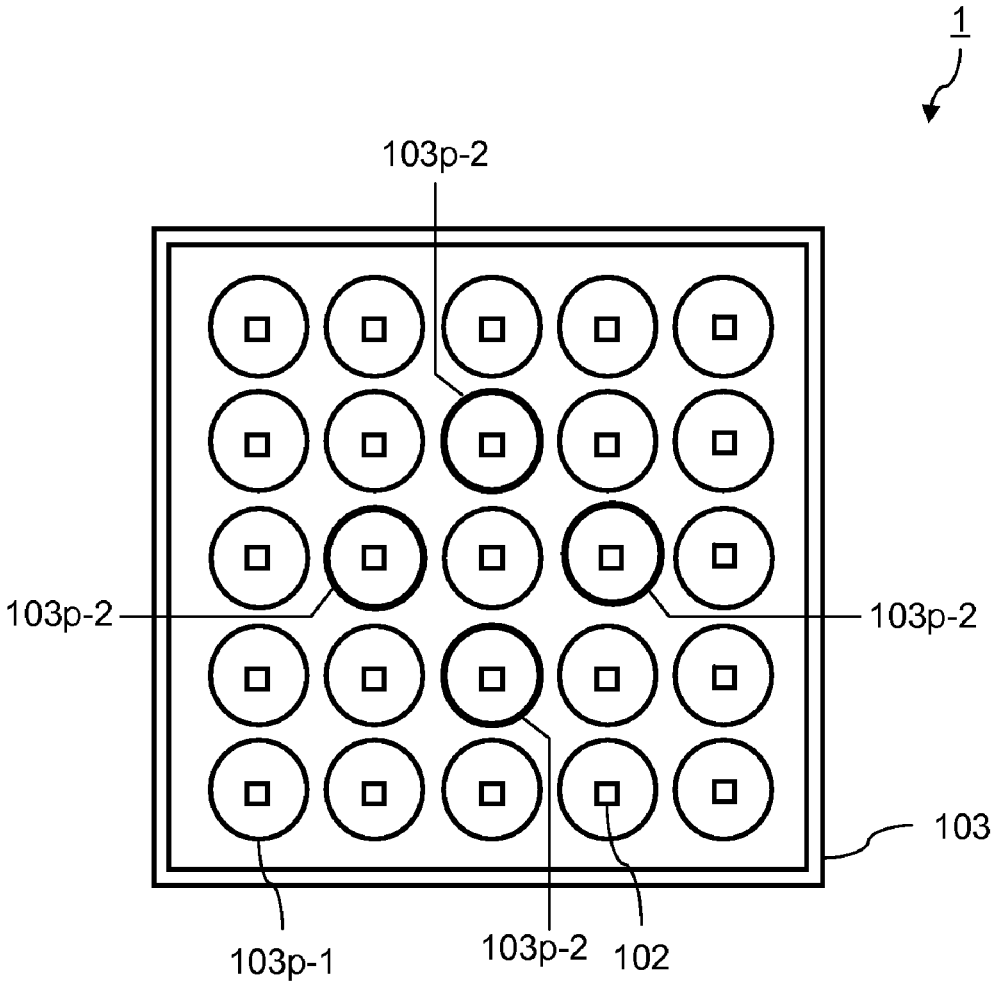
FIG. 11 is a plan view of an illuminating device according to another embodiment of the present invention.
Figure 12:
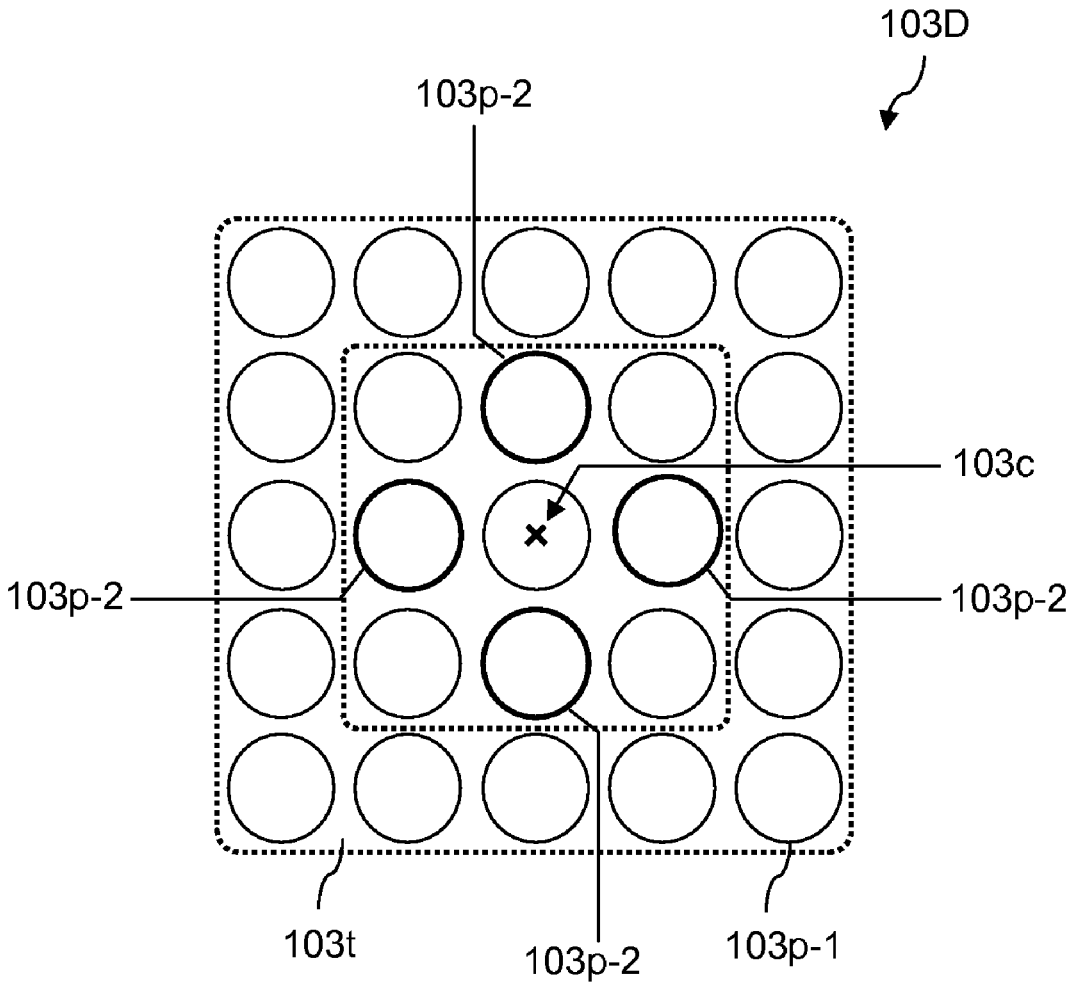
FIG. 12 illustrates an arrangement of light reflecting parts in the illuminating device illustrated in FIG. 11.
Figure 13:
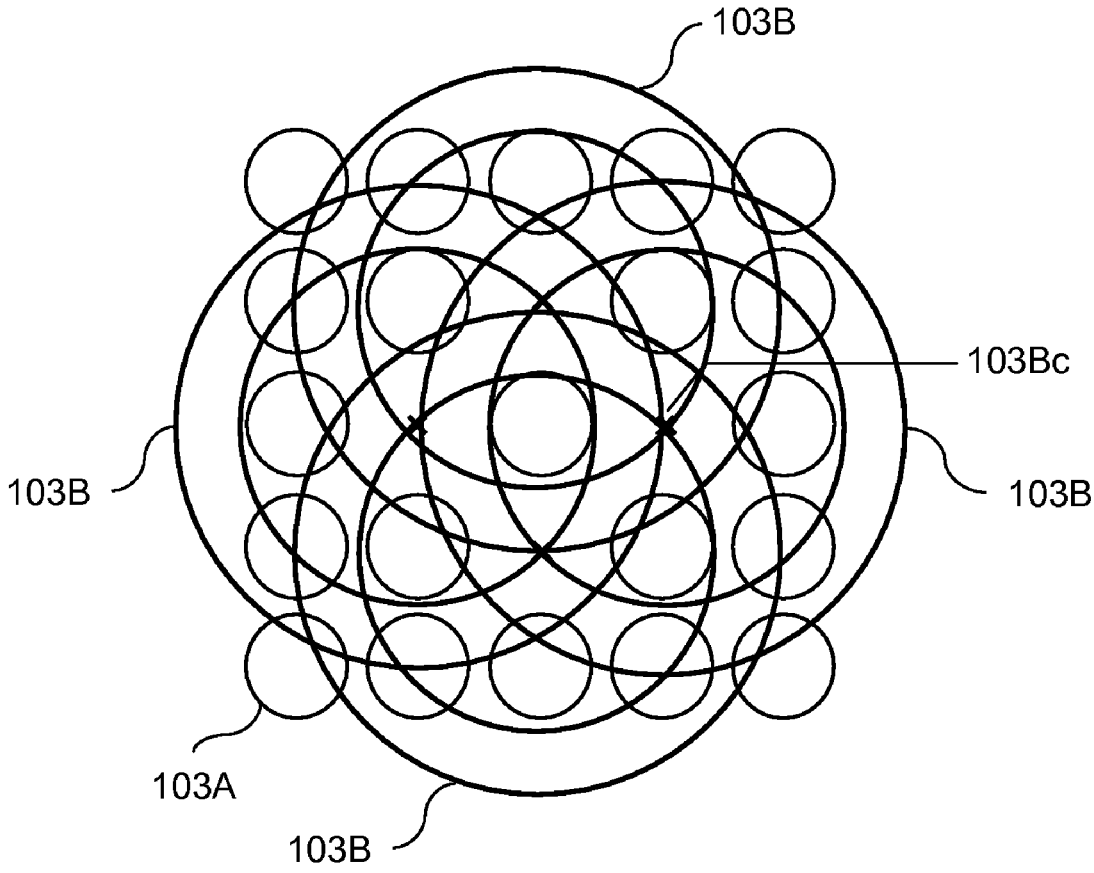
FIG. 13 illustrates an irradiation region of the illuminating device illustrated in FIG. 11.

An illuminating device 1 according to third embodiment of the present invention will now be described with reference to FIG. 11. The third embodiment differs in the number of the second light-reflecting parts 103-*p*2 and their arrangement from the first embodiment. As shown in FIG. 12, four second light-reflecting parts 103*p*-2 are arranged symmetrically about an arrangement center 103*c* of first light-reflecting parts 103*p*-1. The second light-reflecting parts 103*p*-2 are disposed inside an outermost periphery 103*t* of an overall arrangement 103D of the first light-reflecting parts 103-*p*1 and the second light-reflecting parts 103-*p*2. The first light-reflecting parts 103-*p*1 are disposed along the outermost periphery 103*t* of the overall arrangement 103D. The second light-reflecting parts 103-*p*2 are surrounded by the first light-reflecting parts 103*p*-1. In the illuminating device 1 according to the present embodiment, the illuminance uniformity is improved in the irradiation region as shown in FIG. 13.

The present invention is not limited to the above-described embodiments. In addition, various modifications are possible within the scope of the present invention.

For example, each of the light reflecting surfaces may be constituted of a plurality of surfaces. More specifically, each of the light reflecting surfaces may be constituted as a combination of a plurality of polygonal surfaces.

In addition, the light reflecting surfaces may include a light reflecting surface having no light-emitting diode. In reverse, the light-emitting diodes may include a light-emitting diode that is not surrounded by a light reflecting surface.

Moreover, the numbers of first light-reflecting parts and second light-reflecting parts or their ratio is not particularly limited. In addition, third (fourth, fifth, sixth, . . . ) light reflecting parts having third (fourth, fifth, sixth, . . . ) light reflecting surfaces whose shape differs from those of the first and second light reflecting surfaces may also be provided. The different arrangement of the overall arrangement 103D may be used. That is, instead of square shape shown in FIG. 1, the shape of the overall arrangement may be other polygonal shapes such as hexagon or octagon, circular or round shape.

The invention claimed is:

1. An illuminating device, comprising:

a plurality of light-emitting diodes comprising one or more first light-emitting diodes and one or more second light-emitting diodes;

a plurality of first light-reflecting parts, each comprising a first light reflecting surface surrounding the first light-emitting diodes, and a plurality of second light-reflecting parts, each comprising a second light reflecting surface surrounding the second light-emitting diodes, wherein the shape of the first light reflecting surface is different from that of the second light reflecting surface and light emitted from the second light-reflecting parts overlaps light reflected by the first light reflecting surfaces, and wherein the second light-reflecting parts are symmetrically arranged about an arrangement center of the light reflecting surfaces.

2. The illuminating device according to claim 1, wherein the first light-reflecting parts are two-dimensionally arranged.

3. The illuminating device according to claim 2, wherein the second light-reflecting parts are two-dimensionally arranged.

4. The illuminating device according to claim 1, wherein the first light reflecting surface is a parabolic surface.

5. The illuminating device according to claim 4, wherein the second light reflecting surface is an ellipsoidal surface.

6. The illuminating device according to claim 4, wherein the second light reflecting surface is a hyperboloidal surface.

7. The illuminating device according to claim 4, wherein the second light reflecting surface is a light-scattering surface.

8. The illuminating device according to claim 1, wherein the second light-reflecting parts emit diffused light.

9. The illuminating device according to claim 8, wherein the first light-reflecting parts emit parallel light.

10. An illuminating device, comprising:

a plurality of light-emitting diodes comprising one or more first light-emitting diodes and one or more second light-emitting diodes;

a plurality of first light-reflecting parts, each comprising a first light reflecting surface surrounding the first light-emitting diodes, and a plurality of second light-reflecting parts, each comprising a second light reflecting surface surrounding the second light-emitting diodes, wherein the shape of the first light reflecting surface is different from that of the second light reflecting surface and the second light-reflecting parts emit annular light, wherein the second light-reflecting parts are symmetrically arranged about an arrangement center of the light reflecting surfaces.

11. The illuminating device according to claim 10, wherein the first light-reflecting parts emit parallel light.

* * * * *